United States Patent [19]

Schell

[11] 4,388,391

[45] Jun. 14, 1983

[54] PROCESS FOR THE MANUFACTURE OF A LITHOGRAPHIC PRINTING FORM BY ELECTROPHOTOGRAPHY

[75] Inventor: Loni Schell, Hofheim, Fed. Rep. of Germany

[73] Assignee: Hoechst Aktiengesellschaft, Frankfurt am Main, Fed. Rep. of Germany

[21] Appl. No.: 232,888

[22] Filed: Feb. 9, 1981

[30] Foreign Application Priority Data

Feb. 15, 1980 [DE] Fed. Rep. of Germany ..... 3005695

[51] Int. Cl.[3] ..... G03G 13/26; G03G 13/32

[52] U.S. Cl. ..... 430/49; 430/125; 430/309; 101/457; 101/DIG. 13

[58] Field of Search ..... 430/11, 12, 17, 18, 430/49, 125, 331; 101/DIG. 13, 457, 462

[56] References Cited

U.S. PATENT DOCUMENTS

| | | | |
|---|---|---|---|
| 3,121,009 | 2/1964 | Giaimo, Jr. . | |
| 3,158,476 | 11/1964 | Uhlig . | |
| 3,220,832 | 11/1965 | Uhlig | 430/49 X |
| 3,257,203 | 6/1966 | Süs et al. . | |
| 3,276,868 | 10/1966 | Uhlig . | |
| 3,396,019 | 8/1968 | Uhlig . | |
| 3,396,020 | 8/1968 | Borchers . | |
| 3,399,994 | 9/1968 | Watkinson | 430/331 X |
| 3,438,778 | 4/1969 | Uhlig . | |
| 3,745,028 | 7/1973 | Rauner | 430/331 |
| 4,063,948 | 12/1977 | Lind . | |
| 4,066,453 | 1/1978 | Lind . | |
| 4,254,196 | 3/1981 | Seeley et al. | 430/49 X |

FOREIGN PATENT DOCUMENTS

| | | |
|---|---|---|
| 1117391 | 5/1962 | Fed. Rep. of Germany . |
| 1120875 | 7/1962 | Fed. Rep. of Germany . |
| 1134093 | 2/1963 | Fed. Rep. of Germany . |
| 2526720 | 12/1976 | Fed. Rep. of Germany . |
| 2322047 | 1/1978 | Fed. Rep. of Germany . |
| 944126 | 12/1963 | United Kingdom . |
| 2020228 | 11/1979 | United Kingdom . |

*Primary Examiner*—Roland E. Martin, Jr.

*Attorney, Agent, or Firm*—Schwartz, Jeffery, Schwaab, Mack, Blumenthal & Koch

[57] ABSTRACT

Disclosed is a process for manufacturing a lithographic printing form by electrophotographic means, comprising the steps of uniformly charging an oleophilic photoconductive layer which is present on an electrically conductive hydrophilic layer support and which contains a photoconductor and a binder; image-wise exposing the charged photoconductive layer to produce a charge image; developing the charge image with toner to produce a toner image comprised of imaged areas and non-image areas; fixing the toner image; decoating the non-image areas of the photoconductive layer to bare the electrically conductive layer support; coating the bared areas of the layer support with a solution comprising a water-soluble, but hydrocarbon-insoluble film-forming polymer and a vinyl phosphonic acid compound; drying the coating solution to form a uniform coating; and removing the toner image by rinsing with a hydrocarbon composition containing aromatic portions in an amount of at least about 20% by weight. Also disclosed is an improved printing form made by this process.

11 Claims, No Drawings

PROCESS FOR THE MANUFACTURE OF A LITHOGRAPHIC PRINTING FORM BY ELECTROPHOTOGRAPHY

BACKGROUND OF THE INVENTION

The present invention relates to a process for the manufacture of a lithographic printing form by electrophotographic means.

Processes of this kind are known and are, e.g., described in German Pat. No. 11 17 391, German Offenlegungsschrift No. 23 22 047, and German Offenlegungsschrift No. 25 26 720. In conventional embodiments of the process, a photoconductive layer which has been applied to an electrically conductive layer support is charged, exposed image-wise, and developed with liquid or dry toner to give an image. The toner image is then fixed by heating, and finally the printing plate is decoated by removing the unprotected background areas of the photoconductive layer. The offset printing form thus obtained is ink-receptive in the toner image areas and water-receptive in the bared areas of the support surface.

It has shown that, especially in larger continuous full shade areas, printing forms prepared in this way have a tendency to exhibit voids where no ink is transferred. When examining the causes, it was found that the toner, which usually contains a resin which is soluble in organic solvents, most probably swells and gets sticky when it remains in contact with ink for a longer period of time. Then, the toner is able to hold dirt particles or to form an uneven, wrinkled surface.

SUMMARY OF THE INVENTION

It is therefore an object of the present invention to provide an improved process for the manufacture of lithographic printing forms.

A further object of the present invention resides in the provision of a process for manufacturing lithographic printing forms by an electrophotographic method which produces a printing form which does not possess the disadvantages referred to above.

It is also an object of the present invention to provide an improved lithographic printing form.

In accomplishing the foregoing objects, there has been provided in accordance with the present invention a process for the manufacture of a lithographic printing form by electrophotographic means, comprising the steps of uniformly charging an oleophilic photoconductive layer which is present on an electrically conductive hydrophilic layer support and which contains a photoconductor and a binder; image-wise exposing the charged photoconductive layer to produce a charge image; developing the charge image with toner to produce a toner image comprised of imaged areas and non-image areas; fixing the toner image; decoating the non-image areas of the photoconductive layer to bare the electrically conductive layer support; coating the bared areas of the layer support with a solution comprising a water-soluble, but hydrocarbon-insoluble film-forming polymer and a vinyl phosphonic acid compound; drying the coating solution to form a uniform coating; and removing the toner image by rinsing with a hydrocarbon composition containing aromatic portions in an amount of at least about 20% by weight. The process optionally includes the step of decoating the non-image areas of the layer support by rinsing with water.

In accordance with another aspect of the present invention, there has also been provided a lithographic printing form produced by the process defined above.

Further objects, features and advantages of the present invention will become apparent from the detailed description of preferred embodiments which follows.

DETAILED DESCRIPTION OF PREFERRED EMBODIMENTS

The present invention is based on a process for the preparation of lithographic printing forms by electrophotographic means, wherein an oleophilic photoconductive layer, which has been applied to an electrically conductive hydrophilic layer support and comprises a photoconductor and a binder, is uniformly charged, exposed image-wise, treated with toner and fixed, and thereafter the non-image areas of the photoconductive layer are removed by means of a decoating composition.

The process according to the present invention is characterized in that, after decoating, the bared areas of the layer support are coated with a solution of a water-soluble, but hydrocarbon-insoluble film-forming polymer and a vinyl phosphonic acid compound. This solution is dried to form a uniform coating, and thereafter the toner image is removed by rinsing with a hydrocarbon composition containing aromatic portions in an amount of at least about 20% by weight, and then the background areas of the layer support are optionally bared anew by rinsing with water.

By the process according to the present invention, the toner image is completely removed in image-wise configuration from the photoconductive layer which lies underneath it without there being deposited on the background areas of the support oleophilic substances which would cause toning of the printing form. A faultless reproduction of the full shades by the printing form is thus maintained. A further advantage of the process according to the present invention is an improved tone rendering, especially in the case of screened images, since the image elements which have been slightly enlarged by the fused toner are reduced to their original size by removing the toner.

Suitable hydrocarbon compositions, in which the fused toner image is soluble, include any commercial compositions for technical use containing at least 20%, but preferably 70–100% of aromatic portions. Especially preferred are higher-boiling benzene homologues, i.e., alkyl-substituted benzenes having about 8 to 15, preferably about 9 to 13 carbon atoms. The amount of component parts which are detrimental to health, such as trimethyl benzene and propyl benzene, should be kept as low as possible, and the flashpoint of the composition should be higher than about 40° C. As the non-aromatic component parts, other higher-boiling hydrocarbons, especially naphthenes, are suitable.

The density of the hydrocarbon composition preferably lies between about 0.85 and 0.95 g/cm$^3$ at 12° C., measured according to DIN 51 757, and its boiling range preferably lies between about 115° C. and 280° C. The kauributanol value according to ASTM D-1133, in general, ranges between about 70 and 100.

Mixtures of this kind can be employed in conventional commercial processing equipment, and it is not necessary to take any special protective measures against explosion.

By coating the support surface, which has been bared during the decoating step, with the aqueous solution of a film-forming polymer and a vinyl phosphonic acid compound, the hydrophilic support surface is protected from contaminations caused by the organic toner solution.

In principle, any of those substances can be used as the water-soluble film-forming polymers, which are conventionally employed as constituents of preserving solutions for lithographic printing plates, such as, e.g., gum arabic, dextrin and polyvinyl alcohol. The concentration of said polymer, in general, varies between about 4 and 30%, and preferably between about 5 and 15% by weight.

Suitable vinyl phosphonic acid compounds are, e.g., vinyl phosphonic acid, polyvinyl phosphonic acid and vinyl phosphonic acid monomethyl ester. Further suitable compounds are aromatic, substituted aromatic, substituted and non-substituted saturated and unsaturated cyclic, aliphatic, heterocyclic phosphonic acids and also polymers and interpolymers of unsaturated phosphonic acids with each other or with other vinyl compounds. Polyvinyl phosphonic acid is preferably used. The vinyl phosphonic acid compound can be used in concentrations between about 0.05 and 10% by weight, preferably between about 0.2 and 4.0% by weight.

After being treated with the hydrocarbon solvent, the plate surface is usually rinsed with water, during which the water-soluble protective coating is removed together with still adhering toner residues, and the printing form gets a clean outward appearance. If the printing form is not used for printing immediately, it is coated with a conventional preserving solution and dried. It is also possible, especially if the printing form which has been freed from the toner as proposed by this invention is to be stored for only a short period, to leave the protective layer of water-soluble polymers and vinyl phosphonic acid compounds on the background areas and to rinse it off with water just before printing is started.

The photoconductors employed are preferably organic photoconductors which are, e.g., of the types described in German Pat. No. 11 20 875 or in German Auslegeschrift No. 25 26 720. The binders contained in the photoconductive layer are preferably compositions which are insoluble in water and soluble in aqueous-alkaline solutions. Special preference is hereby given to copolymers containing carboxyl groups. The manufacture of suitable electrophotographic materials and their processing into printing forms are conventional and are described in the above publications, the disclosure of which is hereby incorporated by reference.

By way of the following examples, preferred embodiments of the process according to this invention are described. If not otherwise stated, percentages and ratios mean parts by weight.

EXAMPLE 1

A solution of 40 parts by weight of 2-vinyl-4-(2-chlorophenyl)-5-(4-diethylamino phenyl)-oxazol, 47 parts by weight of a copolymer of styrene and maleic acid anhydride having a decomposition temperature ranging from 200° to 240° C., 10 parts by weight of a chlorinated rubber having a viscosity of 5 mPa·s at 25° C. in a 20% toluene solution, and 0.2 part by weight of rhodamine FB (C.I. 45.170) in 510 parts by weight of tetrahydrofuran, 330 parts by weight of ethylene glycol monomethyl ether, and 150 parts by weight of butyl acetate is applied onto a layer support of electrolytically roughened and anodically oxidized aluminum having a thickness of 300 μm and dried to form a uniform photoconductive layer having a weight per unit area of 5 g/m$^2$. By means of a corona, the plate is charged to −450 V and during 25 seconds exposed in a reproduction camera with 8 commercial lamps of 500 W each. The charge image thus obtained is developed with a toner powder comprised of 18 parts by weight of a copolymer of 35% of n-butylmethacrylate and 65% of styrene, and 2 parts by weight of carbon black pigment.

Then the toner image is fixed by heating it to about 170°–180° C. for a short time. From the non-image areas, the photoconductive layer is removed by means of a solution of 12 parts by weight of diethylene glycol monoethyl ether, 10 parts by weight of n-propanol, 1.4 parts by weight of sodium metasilicate nonahydrate, and 76.6 parts by weight of water, and by rinsing with water. The plate is cleaned with a doctor blade and then uniformly coated with a solution of 10 parts by weight of tapioka dextrin having a pH of 2–3 and an Oswald viscosity of 2–50 mPa·s, 1 part by weight of glycerol, 0.3 part by weight of phosphoric acid, 85%, 2.5 parts by weight of sodium n-octyl sulfate, and 2 parts by weight of polyvinyl phosphonic acid having a viscosity of 30 mPa·s at 20° C. in water in a concentration of 33% by weight, in 84.2 parts by weight of water, and then dried. Thereafter, the toner is washed off by slightly rubbing with a mixture of benzene homologues, wherein the $C_9$ portion is 8%, the $C_{10}$ portion is 72%, and the $C_{11}$ portion is 20%. The surplus solution is removed with a doctor blade, the plate is rinsed with water and conventionally preserved with a preserving solution. A printing form free from toning is obtained.

The above test is repeated, whereby the dextrin solution is prepared without the addition of polyvinyl phosphonic acid. The printing form thus obtained is clearly susceptible to toning.

EXAMPLE 2

A layer support of mechanically roughened and anodically oxidized aluminum having its oxide layer treated with an aqueous 0.1% strength solution of polyvinyl phosphonic acid is coated with a solution of 40 parts by weight of 2,5-bis-(4-diethylamino phenyl)-oxdiazole, 40 parts by weight of a copolymer of styrene and maleic acid anhydride having a decomposition temperature ranging from 200° to 240° C., and 2 parts by weight of Astrazonorange R (C.I. 48.040) in 14 parts by weight of methanol, 105 parts by weight of butyl acetate, 400 parts by weight of tetrahydrofuran, and 300 parts by weight of ethylene glycol monomethyl ether.

After drying a photoconductive layer having a weight per unit area of 5 g/m$^2$ is obtained.

As described in Example 1, the plate is charged, image-wise exposed, developed with toner, fixed, decoated, and then coated with a solution of 7 parts by weight of gum arabic, 0.3 part by weight of formaldehyde, and 1 part by weight of polyvinyl phosphonic acid having a viscosity of 230 mPa·s at 20° C. in water in a concentration of 33% by weight in 91.7 parts by weight of water and dried. Then the toner image is removed by rubbing with a mixture of 14% of naphthene hydrocarbons, 20% of $C_{10}$ benzene homologues, 22% of $C_{11}$ benzene homologues, and 44% of $C_{12-13}$ benzene homologues. The surplus solvent is removed with a doctor blade, the plate washed with water and preserved with a commercial preserving solution. The printing form thus obtained is free from toning.

Similar results were obtained when the test was carried out by using a layer support consisting of electrolytically roughened and anodically oxidized aluminum.

What is claimed is:

1. A process for the manufacture of a lithographic printing form by electrophotographic means, comprising the steps of:

uniformly charging an oleophilic photoconductive layer which is present on an electrically conductive hydrophilic layer support and which contains a photoconductor and a binder;

image-wise exposing the charged photoconductive layer to produce a charge image;

developing the charge image with toner to produce a toner image comprised of imaged areas and non-image areas;

fixing the toner image;

decoating the non-image areas of the photoconductive layer to bare the electrically conductive layer support;

coating the bared areas of the layer support with a solution comprising a water-soluble, but hydrocarbon-insoluble film-forming polymer and a vinyl phosphonic acid compound;

drying the coating solution to form a uniform coating; and removing the toner image by rinsing with a hydrocarbon composition containing aromatic portions in an amount of at least about 20% by weight, whereby said coating containing said vinyl phosphonic acid compound prevents deposition in non-imaged background areas of toner image substances which would cause toning of said printing form.

2. A process as claimed in claim 1, further comprising the step of decoating the non-image areas of the layer support by rinsing with water.

3. A process as claimed in claim 1, wherein said polymer is selected from dextrin, gum arabic or polyvinyl alcohol.

4. A process as claimed in claim 1, wherein the vinyl phosphonic acid compound comprises polyvinyl phosphonic acid.

5. A process as claimed in claim 1, wherein the concentration of the vinyl phosphonic acid compound in the solution is between about 0.05 and 10% by weight.

6. A process as claimed in claim 5, wherein the concentration of the vinyl phosphonic acid compound in the solution is between about 0.2 and 4% by weight.

7. A process as claimed in claim 1, wherein the hydrophilic layer support comprises anodically oxidized aluminum.

8. A process as claimed in claim 1, wherein the hydrocarbon composition contains from about 70 to 100% by weight of aromatic portions.

9. A process as claimed in claim 1, wherein the aromatic portions of the hydrocarbon composition comprise alkyl-substituted benzenes having between about 8 and 15 carbon atoms.

10. A process as claimed in claim 1, wherein the photoconductive layer employed contains an organic photoconductor.

11. A process as claimed in claim 1, wherein the photoconductive layer employed contains a binder which is insoluble in water and soluble in aqueous-alkaline solutions.

* * * * *